US006568362B2

(12) United States Patent
Whealton et al.

(10) Patent No.: US 6,568,362 B2
(45) Date of Patent: May 27, 2003

(54) ROTATING ARC SPARK PLUG

(75) Inventors: John H. Whealton, Oak Ridge, TN (US); Chin-Chi Tsai, Oak Ridge, TN (US)

(73) Assignee: Ut-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/879,607

(22) Filed: Jun. 12, 2001

(65) Prior Publication Data

US 2002/0185096 A1 Dec. 12, 2002

(51) Int. Cl.[7] ..... F02P 23/00
(52) U.S. Cl. ..... 123/143 B; 313/118
(58) Field of Search ..... 123/143, 143 B, 123/144, 169 R; 313/118

(56) References Cited

U.S. PATENT DOCUMENTS

| | | | | | |
|---|---|---|---|---|---|
| 4,841,925 | A | * | 6/1989 | Ward | 123/143 B |
| 5,210,458 | A | | 5/1993 | McDougal | |
| 5,555,862 | A | | 9/1996 | Tozzi | |
| 5,619,959 | A | | 4/1997 | Tozzi | |
| 6,321,733 | B1 | * | 11/2001 | Suckewer et al. | 123/143 B |

* cited by examiner

*Primary Examiner*—John Kwon
(74) *Attorney, Agent, or Firm*—Akerman Senterfitt

(57) ABSTRACT

A spark plug device includes a structure for modification of an arc, the modification including arc rotation. The spark plug can be used in a combustion engine to reduce emissions and/or improve fuel economy. A method for operating a spark plug and a combustion engine having the spark plug device includes the step of modifying an arc, the modifying including rotating the arc.

44 Claims, 7 Drawing Sheets

$B = 0$ $B \sim B_o/10$ $B \sim B_o/4$ $B = B_o = 2.5KG$

*Background*

*Spark - No Magnet*

*Spark - Yes Magnet*

ROTATING ARC SPARK PLUG

STATEMENT REGARDING FEDERALLY SPONSORED RESEARCH OR DEVELOPMENT

The United States Government has rights in this invention pursuant to Contract No. DE-AC05-00OR22725 between the United States Department of Energy and UT-Battelle, LLC.

FIELD OF THE INVENTION

This invention relates to spark ignition engines in general and more particularly to spark ignition systems.

BACKGROUND OF THE INVENTION

A conventional spark plug is adapted for insertion into an opening of an engine where an air-fuel mixture is present. This area is typically referred to as a cylinder or combustion chamber of the engine. Spark plugs are provided with an electrically insulating shell through which a high voltage electrode, also commonly referred to as the anode, extends into the combustion chamber. The high voltage electrode is connected to an ignition system which supplies a high voltage pulsating "DC signal" which is applied during each combustion cycle at a time when the piston is approaching the end of its upward motion and the valves are closed.

A second electrode is commonly referred to as the ground electrode or cathode. The ground electrode is typically a projection or protrusion extending inward from the shell of the spark plug and disposed in spaced apart relation with the high voltage electrode. The ground electrode is also disposed within the combustion chamber and is electrically common with the combustion chamber. The electrode separation distance is commonly referred to as an air gap or spark gap. The high voltage signal pulsating DC signal is sufficient to generate an electrical arc (or spark) across the air gap.

The spark generated quickly develops into a low impedance arc. The volume occupied by the arc is low, the reactivity of the arc is low and the electrode erosion rate is high. There is no external magnetic field or other device to cause the arc to move about or to otherwise increase in reactivity.

In systems well-known in the art, the spark gap is set prior to installation of the spark plug into a corresponding engine receptacle. Normally, the spark gap is adjusted to a distance to provide an arc having desired characteristics necessary for initiating proper combustion of the air-fuel mixture. Improper combustion can cause poor engine performance such as backfire and result in increased emissions of harmful pollutants such as NOx, unburned or partially oxidized hydrocarbons and CO.

Internal combustion engines which use spark plugs to ignite air-fuel mixtures are commonly referred to as spark ignition engines. Current spark ignition engines are commonly controlled to operate "lean" on fuel, operating at essentially the stoichiometric air/fuel ratio, in order to meet government imposed emission regulations. The stoichiometric ratio is the ratio of air/fuel required to completely combust the fuel. Most emissions generated by the combustion process are significantly reduced through use of a catalyst system positioned in the exhaust stream. The major role of the catalyst system is to reduce levels of NOx, unburned or partially oxidized hydrocarbons, and CO output by the combustion process. Thus, a careful control near the stoichiometric set-point is needed because the chemistry requires a reduction reaction to eliminate NOx while oxidation is required for elimination of unburned or partially oxidized hydrocarbons and CO.

An efficiency increase for internal combustion engines (estimated at up to 14–20%) could be realized if "lean-burn" engines could supplant the current stoichiometric air/fuel engine technology. As used herein, lean-burn is the term used to describe an air/fuel mixture having excess air above the stochiometric air/fuel ratio. A major barrier to lean-burn engine use in the United States is the inability to meet the California and Federal emission standards. In particular, lean-burn engine mixtures have been shown to be unable to sufficiently suppress the generation of NOx during the combustion process. Once produced by the combustion process, current catalyst systems can only reduce NOx levels modestly (<30%) from the levels generated from the combustion process.

Known strategies for reducing NOx formation in lean-burn engines include the use of exhaust gas recirculation. This method involves re-injecting combustion products back into the combustion chamber together with fresh air/fuel. A second strategy operates an engine very close to the lean-combustion misfire limit. The misfire limit occurs when combustion becomes erratic and generally incomplete.

Both of these strategies for reducing NOx formation during combustion are related. Both depend on dilution effects causing suppression of peak combustion temperatures. Thus, they could be used in combination. Pushing engine operation further into the lean regime permits greater potential efficiency gains. However, for lean-burn technology to become viable in view of strict emission standards, a method for suppressing emission of NOx and other environmentally harmful pollutants must be found.

Lean-burn mixtures can also result in ignition instability. The fuel injection and turbulent-mixing process inside the engine cylinders can create mixture stratification that can make ignition unreliable. This effect can become more pronounced for increasingly lean mixtures. Fluid volumes may be produced that are excessively lean to the point that flame propagation can become impeded. The fluid elements nearest the spark event can become particularly lean such that adequate flame kernel development is prevented even though the overall mixture stoichiometry is sufficient to otherwise sustain combustion.

Complete and partial misfires cause significant unburned fuel to be exhausted and engine performance to accordingly degrade. It estimated that up to 95% of the pollution emanating from a running combustion engine is generated during misfires. A misfire can also be followed by a relatively strong combustion event because the residual gases and recirculated gases contain unreacted fuel and oxygen. Thus, at a subsequent instant the air/fuel mixture may have more fuel and air than the engine set-point would otherwise allow. This stronger combustion event can result in a higher combustion temperature than is meant to occur and is likely to produce relatively high quantities of NOx. This general cycle-to-cycle variation in combustion events has been a major focus of engine research. Tolerable levels of misfire are generally accepted to be limited to 1–5 misfires per 1000 combustion events.

Some principles of high-pressure (10 bar) spark discharges are presented to aid in an understanding of the invention. High-pressure sparks have properties which differ from low-pressure (but still collision dominated) sparks. In low pressure sparks, a Townsend discharge may occur where ambient free electrons are accelerated by an electric field and ionize neighboring gas particles through collisions. This is known as electron impact ionization. Newly generated "secondary" electrons are themselves accelerated by the ambient electric field causing an avalanche of electron and positive ion production. In low pressure discharges, the avalanche grows at the electron drift velocity, while plasma densities and associated currents are relatively low and collisional diffusion is usually significant.

At high pressures, such as 10 bar, the plasma charge density may build up to much higher values compared to the charge density normally built up at low pressure (e.g. 1 bar). As a result, the mutual coulomb or space charge forces, are much stronger at high pressures than the vacuum electrostatic forces. Ionization in this case produces an almost perfectly space charge neutralized plasma. However, the coulomb forces due to the residual space charge still dominate the forces due to the applied fields. The resulting space charge shielding of the applied fields by the plasma causes the electrical fields within the forming spark to be quite low.

According to Gauss's Law, this charge configuration makes the electrical field between the emerging spark and the spark plug anode correspondingly higher. This process continues during the ionization avalanche with the electric field in the front of the plasma, commonly referred to as the plasma front, becoming progressively stronger with time. For example, FIG. 1 shows an electrical potential distribution after approximately 1 or 2 nsec after an avalanche has been initiated. This spark phase may be characterized as the breakdown phase. During this phase, regions of high electrical field intensity 100 located between the anode 102 and plasma front 104 correspond to a region having a large gradient in the electrical equipotential lines 106. Regions of high electrical field intensity 100 correspond to regions where auto-ionization is probable.

During the first nanosecond or so of each combustion cycle, the plasma front 104 moves quickly towards anode 102, as a result of high levels of electron impact and photon ionization. The electron temperature may also be increased during this process. This avalanche process differs from the low pressure case in that the speed of propagation of the plasma front 104 can be orders of magnitude greater than the electron drift velocity since photon induced ionization effects can become dominant.

FIG. 2 shows an arc 101 and the resulting equipotential distribution 106 at a time in the combustion cycle later than that shown in FIG. 1. For example, 10 ns or more after the breakdown avalanche. At this point, the breakdown phase has ceased. Velocities of charged particles 112 are indicated by the relative length of the tail associated with each charged particle (squares). The arc 101 does not reach the cathode 108 due to the cathode sheath. The resulting discharge has a high conductivity and develops into a low voltage, high current arc. If this arc were stable it would likely produce less chemical reactivity within it since the electron temperature would be much lower due to the low electric fields because of significant levels of plasma shielding evident from FIG. 2.

During this post breakdown phase, arc and glow discharges can result. Both arc and glow phases produce limited reactivity, with most reactivity occurring near the cathode sheath 110 which is located between the plasma front 104 and the cathode 108. In and near the cathode sheath, the electrical field is relatively higher than other regions of arc 101 and is correspondingly more highly reactive. However, even the reactivity around cathode sheath 110 is substantially less than the region of high electrical field intensity 100 shown in FIG. 1 provided during the short interval in each combustion cycle that comprises breakdown phase (approximately 1 nsec).

Two significant concerns relate to the ability of a combustion engine modeled as a high pressure spark to ignite the fuel. First, the volume occupied by the narrow spark channel is quite low, perhaps 0.003 $mm^3$. Second, the electron temperatures in the arc phase are the lowest, and as a result reaction probability is relatively low. Thus, in order to increase the probability for a fuel ignition event to occur one can attempt to increase the volume occupied by the spark and/or attempt to increase the electron temperature in the arc phase.

Increasing the probability of ignition could provide low emission operation under conditions such as increasingly leaner fuel regimes. This combination could improve fuel economy without a corresponding degradation in engine performance and increase in harmful emission products such as NOx.

A spark plug improvement is noted in SAE 760764 by D. J. Fitzgerald of the Jet Propulsion Laboratory. A generated arc is caused to move by J×B induced magnetic fields. The magnetic fields are induced from the arc current itself. In this manner, the arc is made to cover a larger volume than a standard spark plug embodiment. However the arc current used is many orders of magnitude larger (10,000 Amps) than standard spark plugs in order to provide a sufficient J×B force to move the arc. A power supply large enough to produce the required arc current would not be practical in motor vehicles. Moreover, high arc currents increase electrode erosion rates which reduce spark plug lifetimes. Moreover, high arc currents are known to adversely impact combustion efficiency.

Tozzi, U.S. Pat. Nos. 5,555,862 and 5,619,959 (Tozzi inventions or '862 and '959, respectively), each disclose use of one or more permanent magnets to provide adjustable length spark gaps. In the Tozzi inventions, arcs produced can be moved by application of variable levels and durations of electrode current applied to the high voltage electrode. Based on Tozzi's disclosed electrode configuration and relative positioning, different arc positions result in different spark gap lengths. Magnets are used to reduce the amount of electrode current required to position an arc in a desired position between the electrodes. Thus, Tozzi's magnets are arranged so that a radial magnetic field is established in the area of the air gap to help propel the arc outwardly (axially) from the spark plug cavity to achieve a user desired spark gap length (see FIG. 4 in '862).

In addition, arcs produced by Tozzi generally have a fixed azimuthal orientation having no rotation component. Thus, Tozzi's arc does not expose relatively large volumes of ignitable fuel mixtures to the arc. This reduces the probability of ignition compared to an arc having a varying azimuthal orientation. Tozzi is also subject to anode erosion at breakdown, since breakdown occurs over a small area. Moreover, Tozzi's insulator and electrode configurations result in breakdown occurring largely parallel to magnetic field lines which can cause catastrophic breakdowns which can result in damage to the insulators, which can render an ignition system inoperable.

BACKGROUND TECHNICAL DETAIL

Cylindrical Coordinate System

Cylindrical coordinates are a generalization of two dimensional polar coordinates to three dimensions by superposing a height (denoted z) axis on the polar axis. In this application, (r, θ, z) is normally used. The radial distance is denoted as r, the azimuthal angle θ and the height, axial component or cylindrical axis, z.

Lorentz Force

A Lorentz force is exerted on charged particles moving in regions where a magnetic field is oriented perpendicular to the particle's velocity. In such a situation, the magnetic force serves to move the particle in a circular path. According to the "right hand rule" applicable for positively charged (and "left hand rule" for negatively charged) particles, the magnetic force acting on the charged particle always remains perpendicular to the charged particle's velocity. The magnitude of the magnetic force is:

$$F=q\ V\times B$$

where q is the magnitude of the charge of the charged particle, V its velocity (for collision dominated transport the velocity may be replaced by the mean or drift velocity and the force then becomes the mean force), and B is the magnetic field and "x" is the vector cross product of B and V. Magnetic flux density relation to magnetic scalar potential:

The basic laws of magnetostatics are:

$$\nabla\times B=4\pi J/c$$

$$\nabla\cdot B=0$$

Where J is the current density, B is the vector magnetic induction (or the magnetic flux density) and c is the speed of light. If the current density is zero in the region of interest, $\nabla\times B=0$ permits the expression for B to be written simply as the gradient of a magnetic scalar potential; $B=-\nabla\phi m$.

SUMMARY OF THE INVENTION

An arc utilizing device includes a first electrode, a second electrode electrically insulated and disposed radially outward from the first electrode. The electrodes form a gap region across which an arc can be established. The arc utilizing device also includes a structure for modification of the arc, the modification including rotation of the arc.

A spark plug device includes a substantially electrically insulating shell, a first electrode situated substantially within the shell, the first electrode having a length protruding from the shell defining an axis for rotation. A second electrode is disposed radially outward from the first electrode, the electrodes forming a gap region across which an arc can be established. The spark plug includes a structure for modification of the arc, the modification including rotation of the arc.

The structure for modification can be adapted for oscillating an output of the arc and can include at least one magnet which may be a permanent magnet. The first electrode can include a broadened tip for at least a portion of the first electrode length within the gap region, the broadened length having larger cross sectional areas relative to cross sectional areas adjacent to the gap region.

The arc can rotate in a path substantially around the axis for rotation. The structure for modification can provide a magnetic field oriented substantially parallel to the axis for rotation, whereby an electric field in the gap region generated from an electrical potential applied between the electrodes is oriented substantially radially, or perpendicular to the magnetic field. The structure for modification can provide a magnetic field in the gap region of from approximately 0.05 to 1 Tesla. The gap region can be substantially annular. The electrode spacing can be approximately 0.5 mm to 4 mm in the gap region. The applied electrical potential can be from approximately 5 kV to 80 kV. The magnet can be at least one electromagnet which can be used to also provide a pulsed electrical field between the electrodes.

A method for operating a spark plug device includes the steps of providing a spark plug device having a substantially electrically insulating shell, a first electrode situated substantially within the shell, the first electrode having a length protruding from the shell defining an axis for rotation. A second electrode is disposed radially outward from the first electrode, the electrodes forming a gap region across which an arc can be established. The method includes the step of modifying the arc, the modifying including rotating the arc. The method can further comprise the step of oscillating an output of the arc.

The spark plug can include at least one magnet for modifying the arc which may be a permanent magnet. Rotation can be at least in part around the axis for rotation, produced by at least one magnet generating a magnetic field oriented substantially parallel to the axis for rotation. Accordingly, an electric field in the gap region generated from an electrical potential applied between the electrodes can be oriented substantially radially, or perpendicular to the magnetic field.

At least one magnet can generate a magnetic field strength in the gap region of approximately 0.05 to 1 Tesla. The gap region can be substantially annular. The electrode spacing can be approximately 0.5 mm to 4 mm in the gap region and the applied electrical potential difference can be from approximately 5 kV to 80 kV.

A method for operating a combustion engine includes the steps of providing a spark plug device having a substantially electrically insulating shell, a first electrode situated substantially within the shell, the first electrode having a length protruding from the shell defining an axis for rotation. A second electrode is disposed radially outward from the first electrode, the electrodes forming a gap region across which an arc can be established. The method includes modifying the arc, wherein the arc modifying includes rotating the arc and operating the combustion engine to produce combustion.

The method can further comprise the step of oscillating an output of the arc. The method can include the step of providing the spark plug with at least one magnet for modifying the arc. The at least one magnet can be a permanent magnet. The rotation can be at least in part around the axis for rotation, the at least one magnet generating a magnetic field oriented substantially parallel to the axis for rotation. Accordingly, an electric field in the gap region generated from an electrical potential applied between the electrodes can be oriented substantially perpendicular to the magnetic field.

At least one magnet can generate a magnetic field strength in the gap region of from approximately 0.05 to 1 Tesla. The gap region can be substantially annular having a nearly constant electrode spacing throughout. The electrode spacing can be approximately 0.5 mm to 4 mm in the gap region and the applied electrical potential can be from approximately 5 kV to 80 kV. Operating the combustion engine produces combustion levels of NOx which are reduced compared to NOx levels generated by combustion engines using conventional spark plugs. Operating the combustion engine also can produce levels of NOx which are reduced compared to NOx levels generated by combustion engines using conventional spark plugs. In addition, the fuel efficiency of the combustion engine can be enhanced compared to combustion engines which use conventional spark plugs. The method of operating a combustion engine can further include the step of supplying a lean-burn fuel mixture to the combustion engine which can be an air to fuel ratio of from approximately 20:1 to approximately 100:1.

A combustion engine includes at least one cylinder for receiving a combustible fuel mixture therein. A spark plug combusts the combustible fuel mixture, the spark plug including a first electrode situated substantially within a shell. The first electrode has a length protruding from the shell defining an axis for rotation. A second electrode is disposed radially outward from the electrode, the electrodes forming a gap region across which an arc can be established. The combustion engine also includes a structure for modification of the arc, the modification including rotation. The output of the arc can oscillate. The structure for modification can include at least one magnet. The at least one magnet can be a permanent magnet. The rotation can be at least in part around the axis for rotation, with at least one magnet generating a magnetic field oriented substantially parallel to the axis for rotation, whereby an electric field in the gap region generated from an electrical potential applied between the electrodes is oriented substantially perpendicular to the magnetic field.

At least one magnet can provide a magnetic field strength in the gap region of from approximately 0.05 to 1 Tesla. The gap region can be substantially annular. The electrode spacing can be approximately 0.5 mm to 4 mm in the gap region and the applied electrical potential can be from approximately 5 kV to 80 kV. The combustible fuel mixture can be a lean-burn mixture which can be an air to fuel ratio of from approximately 20:1 to approximately 100:1.

BRIEF DESCRIPTION OF THE DRAWINGS

A fuller understanding of the present invention and the features and benefits thereof will be accomplished upon review of the following detailed description together with the accompanying drawings, in which:

FIG. 3(*b*) is an expanded perspective view of the gap region and surrounding area structure shown in FIG. 3(*a*).

FIGS. 5(*b*)–(*d*) illustrates the resulting spark current as a function of time with increasing applied magnetic field strengths according to an embodiment of the invention.

DETAILED DESCRIPTION OF THE PREFERRED EMBODIMENTS

An improved spark ignition system and method is described which can preferably be used with internal combustion engines. The invention can provide both a greater spark volume and multiplicity of discharges during each spark cycle. The invention may also provide higher electron temperatures and lower electrode erosion rates compared to conventional spark ignition systems. These advantages are achieved through the use of a spark plug having a structure for modification of an arc, the arc modification including rotation. These same advantages can be applied generally to any arc utilizing device configured to include a first electrode, a second electrode electrically insulated and disposed radially outward from the first electrode, the electrodes forming a gap region across which an arc can be established, and structure for modification of the arc, the modification including rotation of the arc.

In a preferred embodiment of the invention, a first electrode is situated substantially within an electrically insulating shell, the first electrode having a length protruding from the shell, the protruding length defining an axis for rotation. A second electrode is disposed radially outward from the first electrode to form a gap region across which an arc can be established. A magnetic field oriented substantially parallel to the axis for rotation is provided in the gap region. A magnetic field oriented parallel to the axis for rotation of the spark plug may also be referred to as an "axial magnetic field."

The invention can produce multiple spark discharges which can rotate around the axis for rotation during a given spark cycle. Multiple discharges can result in the electrical fields and resulting electron temperatures within the gap region to be higher than a conventional spark plug because the invention produces less plasma shielding. Accordingly, the probability of ignition can be increased. Alternatively or additionally, the frequency of misfires can be reduced, engine efficiency can be increased and environmental harmful emissions can be reduced.

Figure 1:
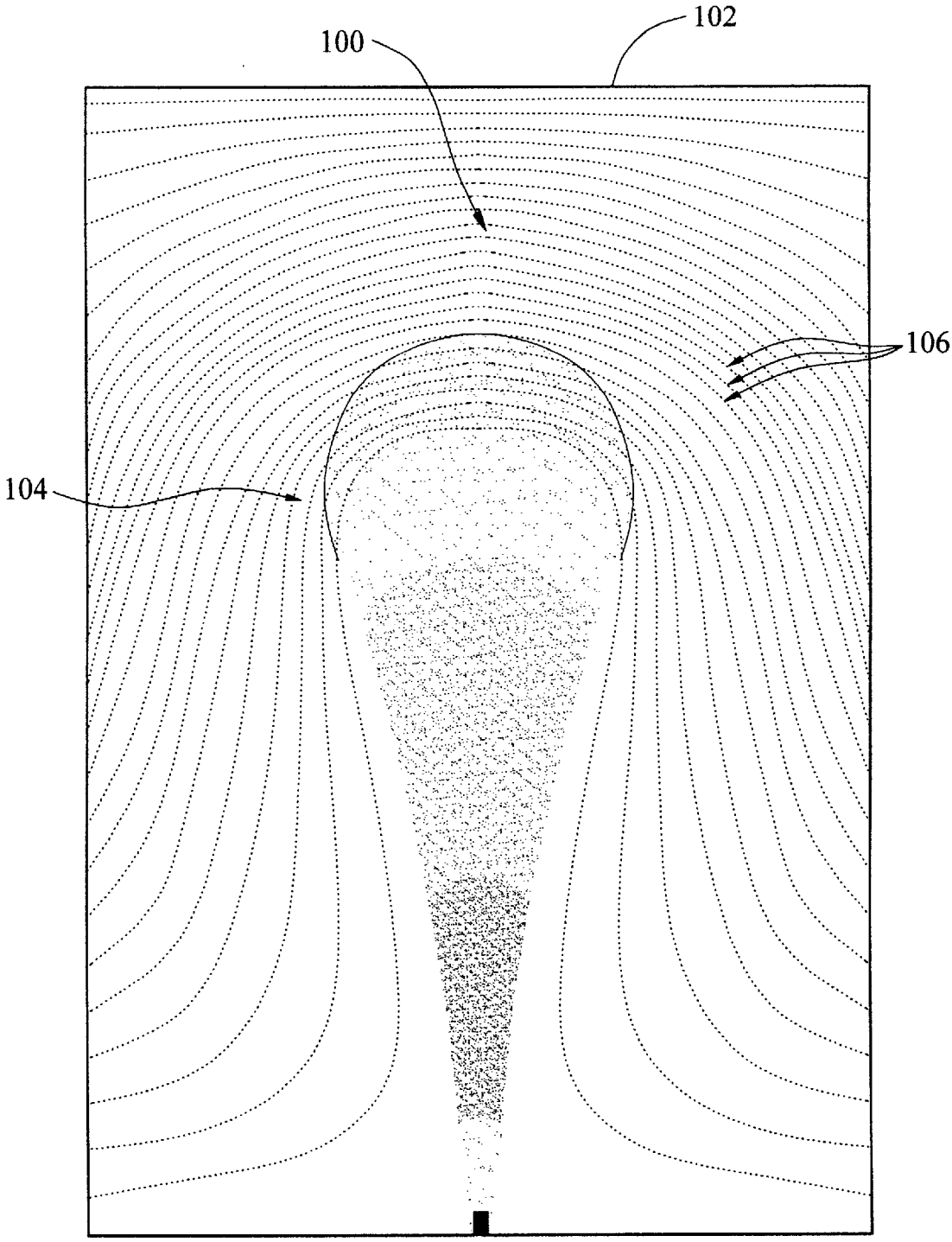
FIG. 1 illustrates a spark discharge and the resulting electrical potential distribution during the breakdown phase the spark discharge.
Figure 2:
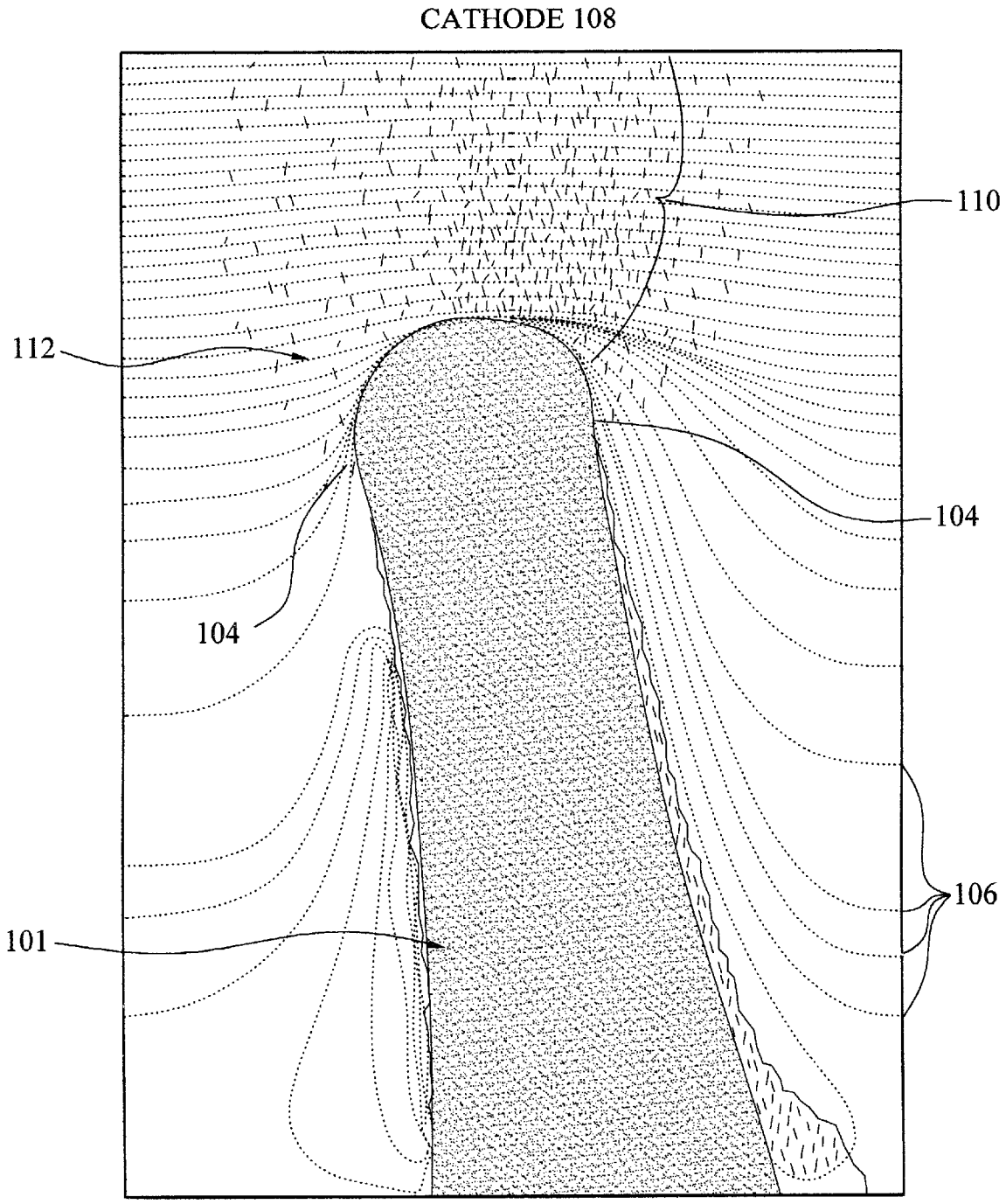
FIG. 2 illustrates a spark discharge and the resulting electrical potential distribution during the arc phase or glow phase.
Figure 3A:
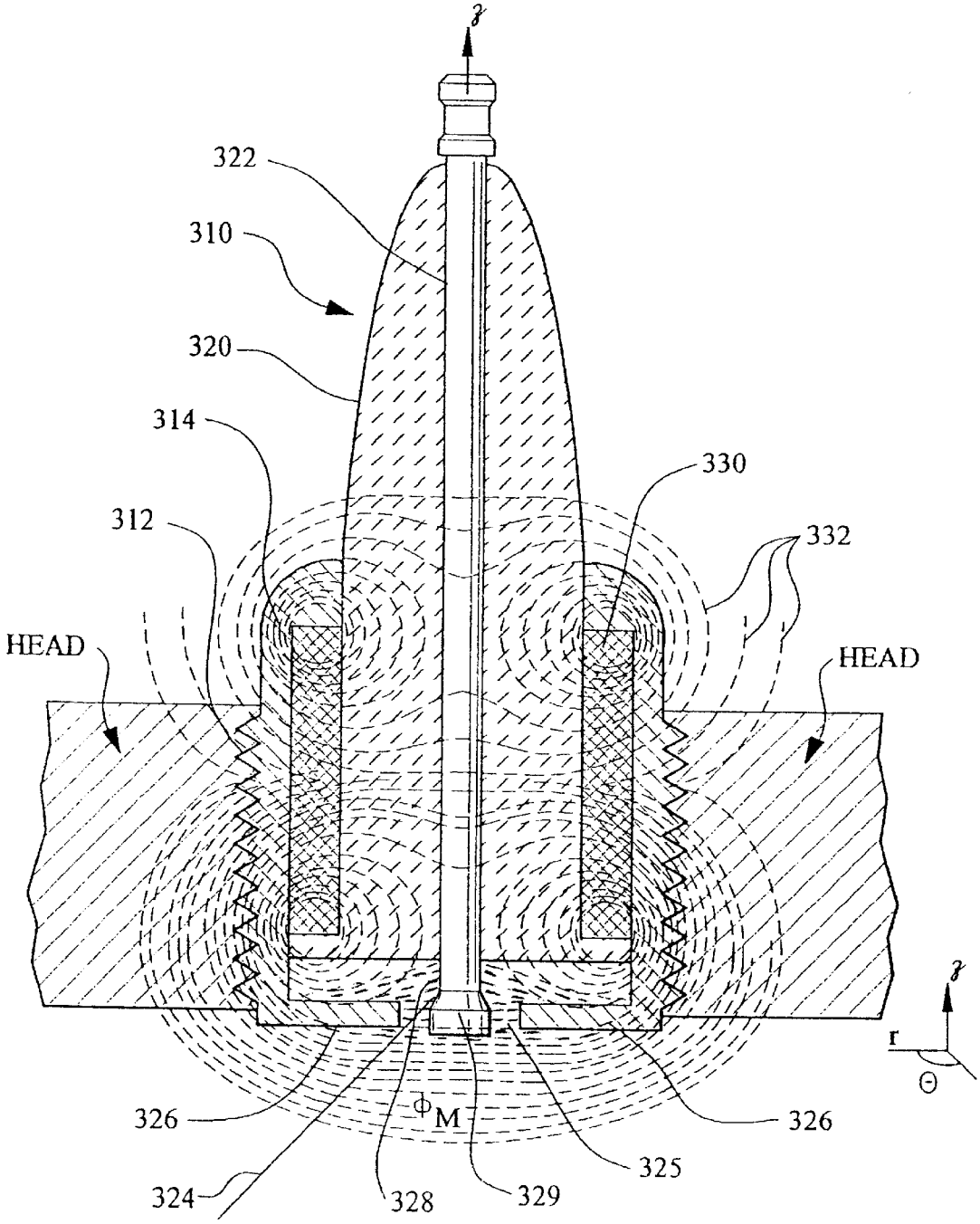
FIG. 3(*a*) illustrates a spark plug suitable for mounting on a combustion engine according to an embodiment of the invention.
Figure 3B:
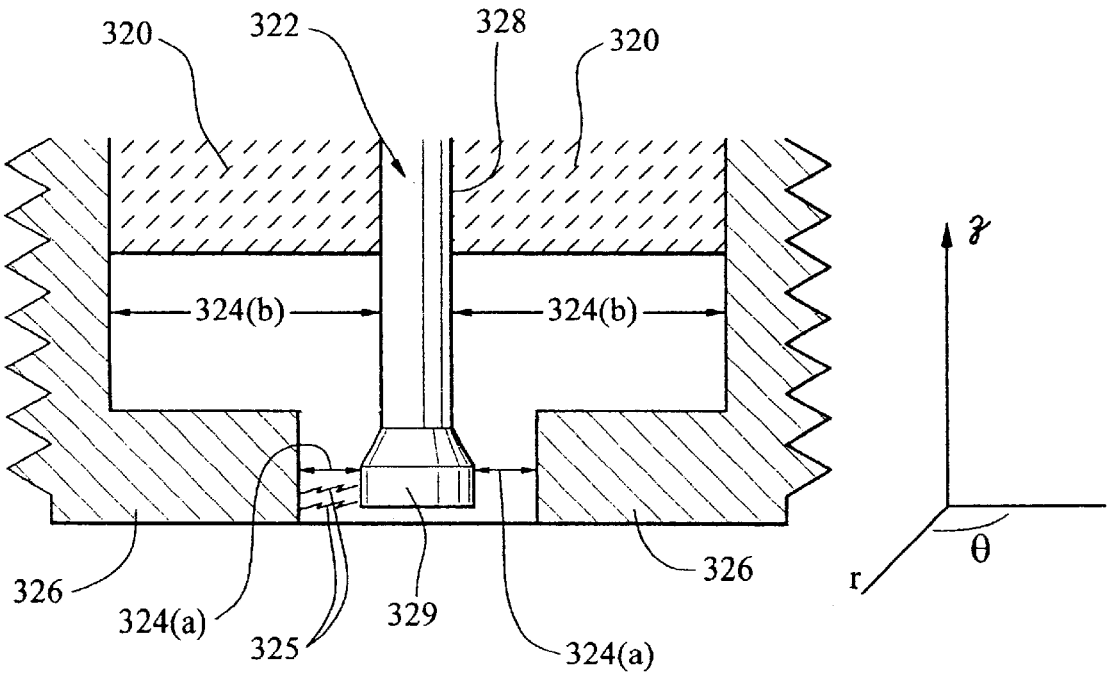

A spark plug according to an embodiment of the invention suitable for mounting in a combustion engine is shown in FIG. 3(*a*). Spark plug 310 includes threads to the engine head 312 which can have external threads sized to match those normally found in a cylinder head or cylinder block wherein a typical spark plug is received in an internal combustion engine (not shown). Collar 314 engages the surface of a cylinder head or cylinder block to provide a tight seal when spark plug 310 is threaded into the head or cylinder of an engine. Threaded portion 312 and collar 314 may be formed from a single piece of metal in the construction of spark plug 310. Electrically insulating shell 320 extends internally through the threaded portion 312 and collar 314. It is contemplated that insulator shell 320 may be formed in a single piece in any shape or size using ceramic materials well known in the art or from an alternative material such as silicon nitride.

High voltage terminal 322 is connected to a source of high energy, typically the ignition system (not shown) of an internal combustion engine. High voltage terminal 322 is normally (but not required to be) an elongated structure which may be aligned with the z axis (axial axis) of a cylindrical coordinate system included as part of FIG. 3(*a*) to facilitate the description of spark plug 310. The axis for rotation for spark plug 310 is substantially coincident to the axial axis.

High voltage electrode 328 is connected to high voltage terminal 322. Electrode 326 is referred to as the ground electrode and is connected internally so that it is electrically common with the engine block (not shown). Ground electrode 326 surrounds the high voltage electrode 328, rather than being separated from the high voltage electrode by an axial (z) distance, as in a conventional spark plug. A high voltage signal applied to high voltage terminal 322 generates an arc 325 in the gap region 324, wherein electrodes 326 and 328 are situated. The arc modification includes rotation of arc 325. In the embodiment shown in FIG. 3(*a*), spark plug 310 includes at least one magnet, such as magnet 330 for modification of arc 325 in gap region 324.

High voltage electrode 328 preferably has a protruding tip 329 as shown in FIG. 3(*a*) which extends a distance beyond the bottom end of the insulator shell 320. Tip 329 is preferably broadened relative to adjacent portion of high voltage electrode 328 to produce a larger inner active electrode radius and better erosion properties. Ground electrode 326 is disposed radially outward from high voltage electrode 328. Thus, a substantially annular gap region 324 is preferably provided across which arc 325 can be established. A substantially cylindrically symmetric electrode configuration results in an arc 325 which has no preferred azimuthal orientation. Thus, arc 325 can be initiated across any portion of gap region 324.

Gap region 324 is actually comprised of sub-regions 324(*a*) and 324(*b*). As shown in FIG. 3(*b*), sub-region 324(*a*) has a smaller electrode spacing compared to sub-region 324(*b*), and accordingly, will have higher resulting electrical field intensities from voltage signals applied to high voltage terminal 322. Accordingly, substantially all spark discharges will occur in sub-region 324(*a*). Consequently, hereinafter, unless otherwise stated, references to gap region 324 will refer to sub-region 324(*a*) and high voltage electrode will refer to high voltage electrode tip 329.

FIG. 3(*b*) is an expanded perspective view of the gap region and insulator shell 320 and surrounding structure shown in FIG. 3(*a*). Arc 325 can thereby begin anywhere within gap region 324 with near equal likelihood. FIG. 3(*b*) shows ground electrode 326 surrounding high voltage electrode tip 329.

Upon application of an electrical potential between cylindrically symmetric high voltage electrode tip 329 and ground electrode 326, the electrical field generated is almost entirely perpendicular to the axis for rotation, being oriented radially along the polar axis with a minimum azimuthal ($\theta$) electrical field component. It is desirable to minimize the azimuthal field component because it can inhibit arc movement and accordingly lead to increased erosion rates and reduced combustion efficiency.

The preferred length of gap region 324 (measured in region 324(*a*)) is from ½ mm to 4 mm. The preferred potential to be initially applied between electrodes 326 and high voltage electrode tip 329 is from approximately 5 kV to 80 kV.

Insulator shell 320 has at least two functions for spark plug 310. First, the shell 320 helps prevent electrical arcing from the electrodes 326 or high voltage electrode 328 or high voltage electrode tip 329 to magnet 330. Second, shell 320 helps provide a thermal isolation barrier between the gap region 324 and magnet 330. Any form of thermal isolation of magnet 330 from the combustion area is helpful to ensure proper operation of the spark plug 310, since combustion chamber temperatures nearby electrodes 326 and 328/329 can reach up to approximately 600–700 degrees Celsius.

Most permanent magnets are known to degrade if exposed to excessive heat. For example, the Curie temperature of a samarium cobalt magnet is approximately 300 degrees Celsius. Accordingly, if magnet 330 is formed from sumarium cobalt, magnet 330 must be maintained at a temperature significantly below that temperature in order for the magnetic fields produced to result in the desired modification of arc 325.

Heat generated in the combustion area may cause the temperature of magnet 330 to rise above a desired maximum magnet 330 temperature. In order to draw heat away from magnet 330, a heat sink sleeve (not shown) can be positioned in physical contact with magnet 330, and between the engine housing (not shown) and magnet 330. Accordingly, the temperature of magnet 330 will remain substantially equivalent to the temperature of the engine block (not shown). Although the present invention contemplates any material having high thermal conductivity as the heat sink sleeve (not shown), a preferred material is copper due to its low cost and excellent thermal conductivity.

A structure is provided for rotating the arc 325 and/or oscillating an output of the arc 325. In the embodiment shown in FIG. 3(*a*), a permanent magnet 330 supplies a magnetic field for this purpose. Suitable magnets 330 can generate equipotential lines of magnetic scalar potential ($\phi$m) 332. Since the current density resulting from arc 325 is relatively small in gap region 324, self-magnetic field of the arc can be neglected. Therefore, in a region of interest, $\nabla \times B=0$ permits the expression for the vector magnetic induction (B) to be written simply as the gradient of the magnetic scalar potential; $B=-\nabla\phi m$. Thus, providing equipotential magnetic scalar lines 332 substantially oriented perpendicular to the axis for rotation in gap region 324 results in the desired substantially axial magnetic flux density B. Through use of an applied magnetic field oriented substantially parallel to axis for rotation of spark plug 310, a broader spark (time-averaged) can be provided due to the resulting Lorentz force applied to moving charged particles comprising arc 325.

The Lorentz force causes arc 325 to rotate along the spark plug's 310 axis of rotation because the Lorentz force for an axial magnetic field tends to convert a radial arc current generated by the applied electrical field in gap region 324 into an azimuthal current, particularly at the cathode fall (plasma sheath) near electrode 326. Modes likely oscillate because the shear magnetic drift due to an inhomogeneous electric field or the counter-rotation at the smaller high voltage electrode 329 can eventually disrupt the spark channel forcing the spark to largely dissipate. Thus, the invention causes arc 325 to cycle between on and nearly off status reformation multiple times during a given spark plug cycle.

Accordingly, desirable high impedance characteristics having minimum plasma shielding analogous to the initial breakdown stage (e.g <10 nsec) of a conventional arc discharge can recur multiple times during a given spark cycle. This high impedance phase produces relatively high electron temperatures that in turn produces highly excited molecular states and result in a high level of chemical reactivity. This significantly enhances the probability of ignition.

The desired substantially axial magnetic field in gap region 324 can be generated, for example, by permanent magnets and/or by electromagnets. A permanent magnet, such as a SmCo or NbFeB magnet, can produce magnetic fields without an operating cost, require no power or electrical connection, and is regarded as generally unaffected by shock or vibrations. However, permanent magnets can be difficult to change the magnet field produced and cannot be switched on or off, except in very specialized applications.

In the embodiment shown in FIG. 3(*a*), a single continuous permanent magnet 330 is disposed outside shell 320 and oriented substantially cylindrically symmetric to the spark plug axis to produce a substantially axial magnetic field in gap region 324.

In an alternate embodiment, the structure for modifying the arc including rotation utilizes an electromagnet. An electromagnet can be formed from a current-carrying coil of an insulated wire wrapped around a piece of ferromagnetic material such as annealed iron which creates a magnetic field inside the iron only when the wire conducts a current. Thus, the magnetic field strength of an electromagnet is readily controllable. Additionally, electromagnets can operate effectively at temperatures up to 600 degrees Celsius or more. This is desirable as combustion chamber temperatures at the nearby electrodes 326 and 329 can reach up to 600–700 degrees Celsius or more.

Electromagnets also permit spark plug 310 to have conventional spark plug sizing, assuming the electromagnet coil is externally wound. However, this embodiment has a number of disadvantages compared to the preferred embodiment (permanent magnets). More electrical power is needed to power the coil which can be more than the rest of the spark plug. In addition, use of electromagnets impose more constraints on ferromagnetic engine pieces when the coils are located further away. If coils are located close to spark plug electrodes, a larger spark plug cross section is required, thus mitigating a principle advantage of using electromagnets. Finally, transient effects, such as inductive effects, can result if the electromagnet is pulsed.

In another alternate embodiment of the invention, an electromagnetic coil can also be used as the induction unit to generate the pulsed electric field which is applied between the electrodes in gap region 324. In this configuration, a number of advantages can be obtained. Additional electrical power to implement the electromagnet would be small or zero compared to a conventional ignition system. In addition, high voltage cables to the spark plug 310 could be eliminated. However, the coil would have more inductance than would otherwise be required for the electromagnet and would accordingly take up more room. In addition, lack of independent control of the magnet 330 and ignition coil (not shown) may result in some inconvenient effects, such as the inability to separately optimize operating parameters for magnet 330 and ignition coil (not shown).

As a further alternative, a magnet design could incorporate hybrids of these magnetic forms, called electro-permanent magnets. Any of these magnet types can be used to produce relatively uniform, widely distributed and near constant substantially axially oriented magnetic fields in gap region 324.

EXAMPLES

Laboratory investigations were performed on an ignition system supplied with a spark plug, such as 310, according to an embodiment of the invention having a substantially axially oriented applied magnetic field being substantially parallel to spark plug's 310 axis for rotation in the gap region 324. Measurements demonstrate that spark 325 rotates and blinks between at least two modes. Two of these modes may be an arc mode and a glow mode.

Figure 4:
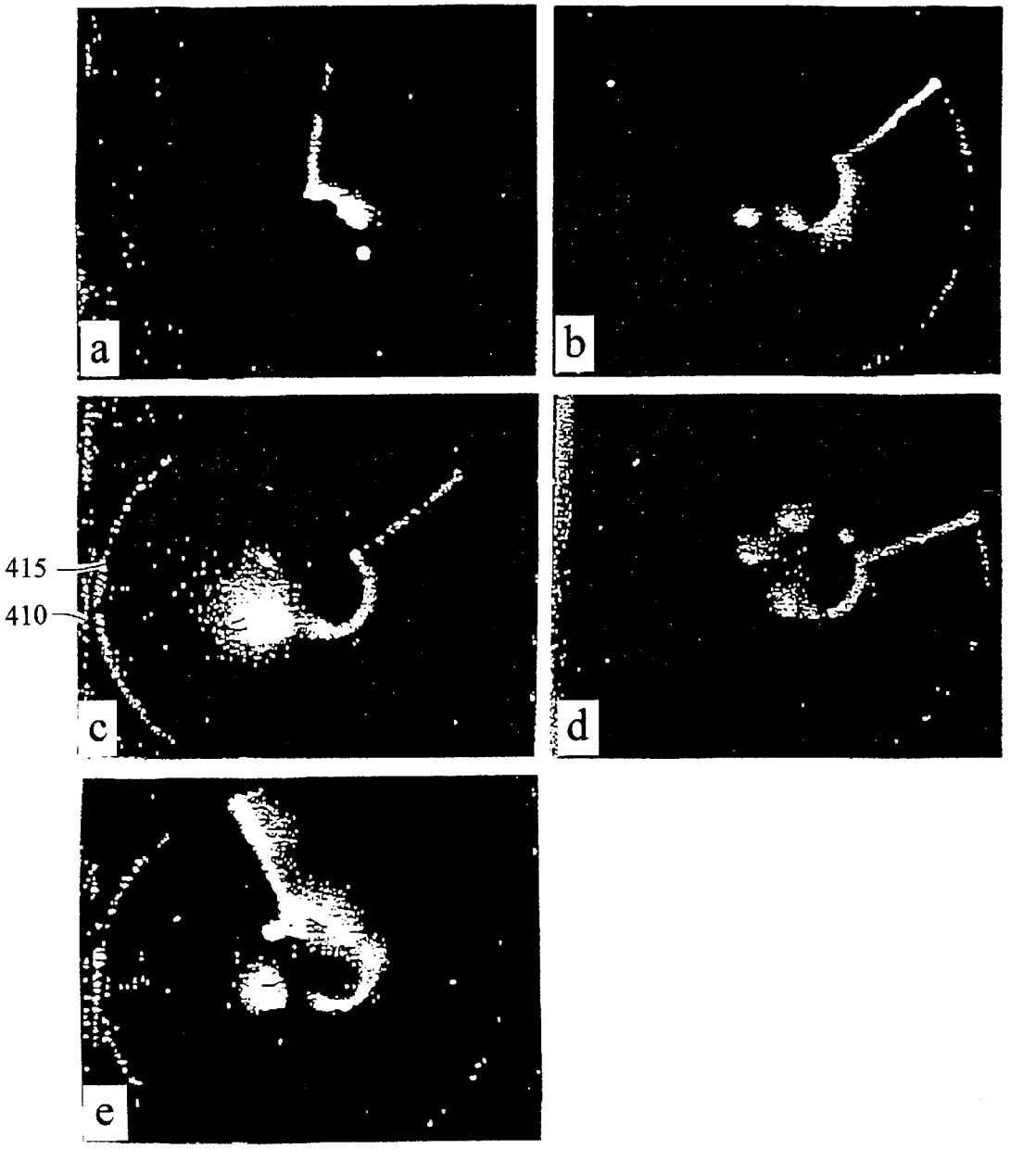
FIGS. 4(*a*)–(*e*) illustrate the movement of an spark discharge over an elapsed time of 750 $\mu$ sec in 150 $\mu$ sec increments according to an embodiment of the invention.
Figure 5A:
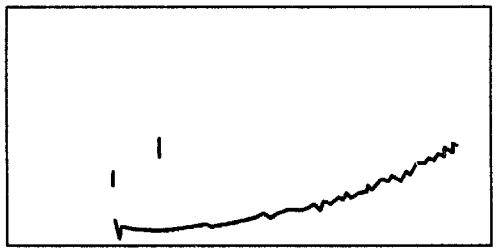
FIG. 5(*a*) illustrates the resulting spark current as a function of time in the absence of an applied magnetic field.
Figure 5B:
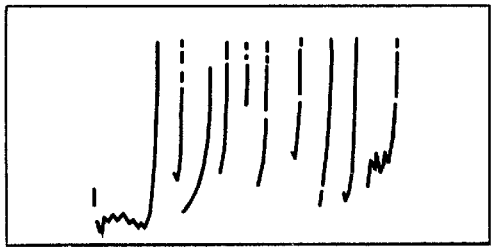
Figure 5C:
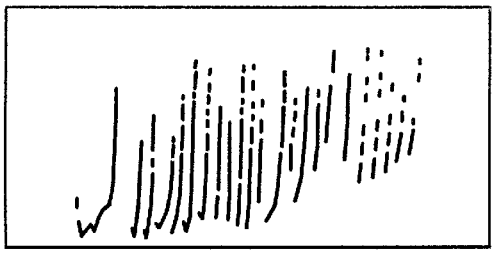
Figure 5D:
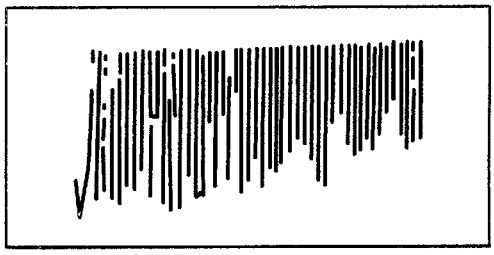

Rotation of the spark 325 provides a spark volume up to approximately two orders of magnitude greater than the spark volume generated by a conventional spark plug. Referring to FIG. 4, photographs are shown taken at different elapsed times of a discharge between two coaxial cylindrical electrodes, such as 326 and 329, with an electrical field (6 kV/4 mm electrode spacing=1.5 kV/mm) imposed between the electrodes. A substantially axial magnetic field (0.1 T) was provided in the gap region 324. The experiments were performed in air at atmospheric pressure for convenience. FIG. 4 shows a sequence of time increments from 150 $\mu$s to 750 $\mu$s. FIG. 4*a* (150 $\mu$s) shows essentially a simple radial arc discharge. At longer times (FIGS. 4(*b*), 4(*c*), 4(*d*) and particularly 4(*e*)), the primary arc discharge can be seen to have rotated. In addition, during these longer times, glow discharges 415 and surface ionization 410 appears in the places where the arc discharge has been. Resulting glow discharges 415 and surface ionization 410 can be as important as the rotating spark itself in terms of providing opportunities for ignition events. Because of the increased spark volume produced, inhomogeneous fuel mixtures are more likely to be ignited.

Referring to FIG. 5, mode oscillation or blinking between an "on" state and a nearly "off" state is shown for four values of axial magnetic field. The resulting spark current as a function of time is displayed. In these figures, current is inverted. Thus, higher spark current is shown as positioned lower on the y-axis of each trace. In FIG. 5(*a*), the applied axial magnetic field is zero as in a conventional spark plug. As shown in FIG. 5(*a*), the spark current shown exhibits the discharge of a charged capacitor and shows conventional spark plug behavior, that being arc discharge current as a function of time equal to approximately a decaying exponential function. In the other cases shown in FIG. 5, each having a finite applied substantially axial magnetic field, the discharge current is seen to periodically blink off and on, remaining for a significant fraction of time in a low current mode. As the axial magnetic field strength in gap region 324 is increased, the oscillation frequency is seen to increase. In the low current mode, which can be denoted as the high impedance mode, a "new" discharge begins forming and results in many electrons accelerated to high energies (up to approximately 10 eV). This high impedance phase produces relatively high electron temperatures that in turn produce high levels of chemical reactivity and accordingly enhances the probability of ignition.

Figure 6A:
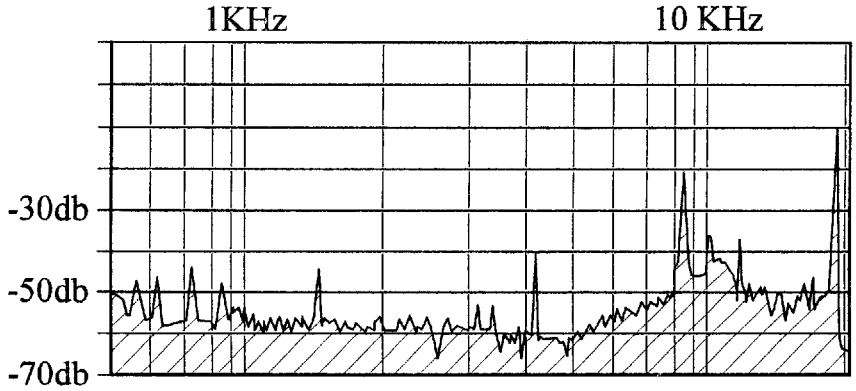
FIGS. 6(*a*)–(*c*) illustrates a sound spectrum generated by a spark which compares a spark plug without an applied magnetic field to the sound spectrum produced by a spark plug having an applied magnetic field according to an embodiment of the invention.
Figure 6B:
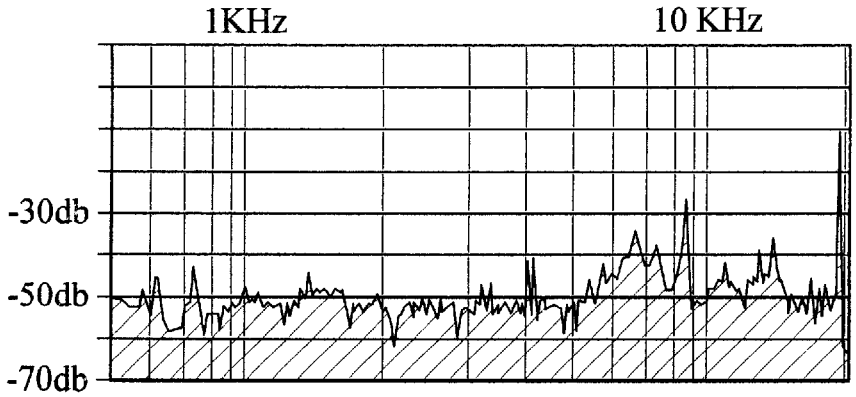
Figure 6C:
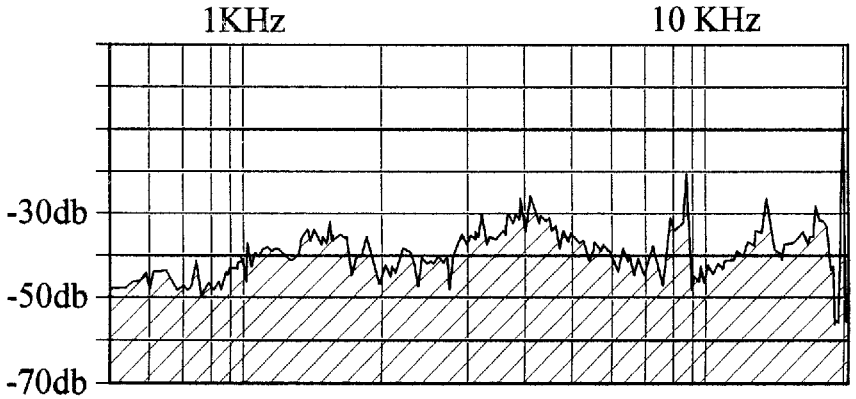

Higher resulting electron temperatures are shown by acoustical spectrum measurements in FIG. 6. The sound generated by spark plug 310 during operation is substantially louder and crisper than the arc produced by a non-rotating conventional spark plug having no axial magnetic field. This effect is attributed to multiple high volume sound emissions generated as the arc channels expands during blinking. For the case of a conventional non-blinking spark this expansion occurs only once during a given spark cycle. FIG. 6(*a*) shows background acoustics. FIG. 6(*b*) shows arc acoustics resulting from no applied axial magnetic field, while FIG. 6(*c*) shows the resulting louder acoustics resulting from arc instability from spark plug 310 based on an embodiment of the invention using a substantially axial magnetic field of 1,000 gauss (0.1 T). Viewing −50 db as a reference level and subtracting background noise (FIG. 6(*a*)), FIG. 6(*c*) shows levels consistently above the −50 db reference level, while FIG. 6(*b*) shows sound levels consistently below the −50 db reference. Louder sound levels produced by spark plug 310 shown in FIG. 6(*c*) result from motion of the discharge including rotation which occur during numerous expansion events which occur during each spark cycle.

During the post breakdown period of a conventional spark discharge, substantial plasma shielding can result in lower internal electric fields, lower electron temperatures, and lower chemical reactivity. These undesirable post discharge arc phenomena produced by convention spark plugs can be reduced by the subject invention due to the motion of the discharge and switching of the arc discharge between a high impedance and low impedance mode.

A preferred application for spark plug 310 is for substantially improving the performance of a combustion engine. Using spark plug 310, lean air/fuel ratios can be used from beyond the stoichiometric ratio up to about 100:1, while maintaining proper engine performance and at the same time minimizing environmentally harmful discharges. Lean-burn fuel mixtures using conventional ignition systems have permitted improved fuel economy, but have resulted in poor engine performance and higher levels of environmentally harmful discharges. A combustion engine equipped with spark plug 310 can produce NOx and other environmentally harmful discharge levels substantially lower compared to combustion engines using conventional spark plugs, particularly when lean-burn fuel mixtures are used.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. An arc utilizing device, comprising:

a first electrode;

a second electrode electrically insulated and disposed radially outward from said first electrode; said electrodes forming a gap region across which an arc is established, and a structure for modification of said arc, said modification including rotation of said arc.

2. A spark plug device, comprising:

a substantially electrically insulating shell;

a first electrode situated substantially within said shell, said first electrode having a length protruding from said shell defining an axis for rotation;

a second electrode disposed radially outward from said first electrode; said electrodes forming a gap region across which an arc is established, and a structure for modification of said arc, said modification including rotation of said arc.

3. The spark plug device of claim 2, wherein said structure for modification is adapted for oscillating or causing fluctuations of said arc.

4. The spark plug device of claim 2, wherein said structure for modification includes at least one magnet.

5. The spark plug device of claim 4, wherein said at least one magnet is a permanent magnet.

6. The spark plug device of claim 2, wherein said first electrode includes a broadened tip for at least a portion of said first electrode length within said gap region, said broadened length having larger cross sectional areas relative to cross sectional areas adjacent to said gap region.

7. The spark plug device of claim 2, wherein said arc rotates in a path substantially around said axis for rotation.

8. The spark plug device of claim 7, wherein said structure for modification provides a magnetic field oriented substantially parallel to said axis for rotation, whereby an electric field in said gap region generated from an electrical potential applied between said electrodes is oriented substantially perpendicular to said magnetic field.

9. The spark plug device of claim 8, wherein said structure for modification provides a magnetic field in said gap region of from approximately 0.05 to 1 Tesla.

10. The spark plug device of claim 8, wherein said gap region is substantially annular.

11. The spark plug device of claim 10, wherein said electrode spacing is approximately 0.5 mm to 4 mm in said gap region.

12. The spark plug device of claim 10, wherein said applied electrical potential is from approximately 5 kV to 80 kV.

13. The spark plug device of claim 4, wherein said magnet is at least one electromagnet.

14. The spark plug device of claim 12, wherein said electromagnet is also used to provide a pulsed electrical field between said electrodes.

15. A method for operating a spark plug device, comprising the steps of:

providing a spark plug device having a substantially electrically insulating shell, a first electrode situated substantially within said shell, said first electrode having a length protruding from said shell defining an axis for rotation, a second electrode disposed radially outward from said first electrode, said electrodes forming a gap region across which an arc is established, and modifying said arc, said modifying including rotating said arc.

16. The method for operating a spark plug device of claim 15, further comprising the step of oscillating or causing fluctuations of said arc.

17. The method for operating a spark plug device of claim 15, wherein said spark plug includes at least one magnet for modifying said arc.

18. The method for operating a spark plug device of claim 17, wherein said at least one magnet is a permanent magnet.

19. The method for operating a spark plug device of claim 17, wherein said rotation is at least in part around said axis for rotation, said at least one magnet generates a magnetic field oriented substantially parallel to said axis for rotation, whereby an electric field in said gap region generated from an electrical potential applied between said electrodes is oriented substantially perpendicular to said magnetic field.

20. The method for operating a spark plug device of claim 17, wherein said at least one magnet generates a magnetic field strength in said gap region of approximately 0.05 to 1 Tesla.

21. The method for operating a spark plug device of claim 19, wherein said gap region is substantially annular.

22. The method for operating a spark plug device of claim 21, wherein said electrode spacing is approximately 0.5 mm to 4 mm in said gap region and said applied electrical potential is from approximately 5 kV to 80 kV.

23. A method for operating a combustion engine, comprising the steps of:

providing a spark plug device having a substantially electrically insulating shell, a first electrode situated substantially within said shell, said first electrode having a length protruding from said shell defining an axis for rotation, a second electrode disposed radially outward from said first electrode, said electrodes forming a gap region across which an arc is established;

modifying said arc, wherein said arc modifying includes rotating said arc, and operating said combustion engine to produce combustion.

24. The method for operating a combustion engine of claim 23, further comprising the step of causing oscillations or fluctuations in output of said arc.

25. The method for operating a combustion engine of claim 23, further comprising the step of providing said spark plug with at least one magnet for modifying said arc.

26. The method for operating a combustion engine of claim 25, wherein said at least one magnet is a permanent magnet.

27. The method for operating a combustion engine of claim 25, wherein said rotation is at least in part around said axis for rotation, said at least one magnet generates a magnetic field oriented substantially parallel to said axis for rotation, whereby an electric field in said gap region generated from an electrical potential applied between said electrodes is oriented substantially perpendicular to said magnetic field.

28. The method for operating a combustion engine of claim 25, wherein said at least one magnet generates a magnetic field strength in said gap region of from approximately 0.05 to 1 Tesla.

29. The method for operating a combustion engine of claim 27, wherein said gap region is substantially annular having a nearly constant electrode spacing throughout.

30. The method for operating a combustion engine of claim 29, wherein said electrode spacing is approximately 0.5 mm to 4 mm in said gap region and said applied electrical potential is from approximately 5 kV to 80 kV.

31. The method of operating a combustion engine of claim 23, wherein said operating said combustion engine to produce combustion produces levels of NOx which are reduced compared to NOx levels generated by combustion engines using conventional spark plugs.

32. The method of operating a combustion engine of claim 23, wherein said operating said combustion engine produces levels of NOx which are reduced compared to NOx levels generated by combustion engines using conventional spark plugs and fuel efficiency of said combustion engine is enhanced compared to combustion engines which use conventional spark plugs.

33. The method of operating a combustion engine of claim 23, further comprising the step of supplying a lean-burn fuel mixture to said combustion engine.

34. The method of operating a combustion engine of claim 33, wherein the air to fuel ratio used by said combustion engine is from approximately 20:1 to approximately 100:1.

35. A combustion engine comprising:

at least one cylinder, said at least one cylinder for receiving a combustible fuel mixture therein, and a spark plug to combust said combustible fuel mixture, said spark plug including a first electrode situated substantially within a shell, said first electrode having a length protruding from said shell defining an axis for rotation;

a second electrode disposed radially outward from said first electrode, said electrodes forming a gap region across which an arc is established, and a structure for modification of said arc, said modification including rotation.

36. The combustion engine of claim 35, wherein an output of said arc oscillates.

37. The combustion engine of claim 35, wherein said structure for modification includes at least one magnet.

38. The combustion engine of claim 37, wherein said at least one magnet is a permanent magnet.

39. The combustion engine of claim 37, wherein said rotation is at least in part around said axis for rotation, said at least one magnet generates a magnetic field oriented substantially parallel to said axis for rotation, whereby an electric field in said gap region generated from an electrical potential applied between said electrodes is oriented substantially perpendicular to said magnetic field.

40. The combustion engine of claim 37, wherein said at least one magnet provides a magnetic field strength in said gap region of from approximately 0.05 to 1 Tesla.

41. The combustion engine of claim 39, wherein said gap region is substantially annular.

42. The combustion engine of claim 41, wherein said electrode spacing is approximately 0.5 mm to 4 mm in said gap region and said applied electrical potential is from approximately 5 kV to 80 kV.

43. The combustion engine of claim 35, wherein said combustible fuel mixture is a lean-burn mixture.

44. The combustion engine of claim 43, wherein said combustible fuel mixture comprises an air to fuel ratio of from approximately 20:1 to approximately 100:1.

* * * * *